US007994882B2

(12) United States Patent
Zende et al.

(10) Patent No.: US 7,994,882 B2
(45) Date of Patent: Aug. 9, 2011

(54) SPACE ALLOCATION WITHIN A CIRCUIT BREAKER

(75) Inventors: Prashant Sudhakar Zende, Bangalore Karnataka (IN); Javier Gomez Martin, Madrid (ES); Jorge Juan Bonilla, Madrid (ES); Ranjit Manohar Deshmukh, Nova Lima (BR); Manuel Meana Alcon, Madrid (ES); Pedro Luis Perez, Madrid (ES)

(73) Assignee: General Electric Company, Schenectady, NY (US)

( * ) Notice: Subject to any disclaimer, the term of this patent is extended or adjusted under 35 U.S.C. 154(b) by 294 days.

(21) Appl. No.: 12/426,248

(22) Filed: Apr. 18, 2009

(65) Prior Publication Data

US 2010/0264000 A1 Oct. 21, 2010

(51) Int. Cl.
*H01H 75/00* (2006.01)
*H01H 13/04* (2006.01)

(52) U.S. Cl. ..... 335/6; 335/18; 335/202

(58) Field of Classification Search ..... 335/6, 18, 335/202

See application file for complete search history.

(56) References Cited

U.S. PATENT DOCUMENTS

| | | | | |
|---|---|---|---|---|
| 5,510,759 | A | 4/1996 | Gula et al. | |
| 5,517,165 | A * | 5/1996 | Cook | 335/18 |
| 5,907,461 | A * | 5/1999 | Hartzel et al. | 361/42 |
| 6,259,340 | B1 * | 7/2001 | Fuhr et al. | 335/18 |
| 6,487,057 | B1 * | 11/2002 | Natili | 361/42 |
| 7,170,376 | B2 | 1/2007 | Mills et al. | |

FOREIGN PATENT DOCUMENTS

WO WO 02080329 10/2002

* cited by examiner

*Primary Examiner* — Ramon M Barrera
(74) *Attorney, Agent, or Firm* — Cantor Colburn LLP

(57) ABSTRACT

A single pole module of a circuit breaker is disclosed. The housing includes a first portion and a second portion, and an interior wall separating the first portion from the second portion. The first portion includes a first section receiving a circuit board and a second section receiving a lever mechanism. The second portion includes a first section receiving an electromagnetic protection device, a second section receiving an arc extinguishing device, a third section receiving a thermal protection device, and a fourth section receiving an operating mechanism. The first and second sections of the first portion occupy substantially half of the housing and the first, second, third and fourth sections of the second portion occupy substantially half of the housing and the second section of the first portion and the third section of the second portion are opposite each other.

22 Claims, 21 Drawing Sheets

SPACE ALLOCATION WITHIN A CIRCUIT BREAKER

BACKGROUND OF THE INVENTION

The subject matter disclosed herein relates to circuit breakers. More particularly, to space allocation within the housing of a circuit breaker, and an interface to trip the circuit breaker.

A conventional electronic residual current circuit breaker with overcurrent protection ("eRCBO") includes single housing configured to provide a miniature circuit breaker (MCB) portion and a residual current (for example, a ground fault) device (RCD) portion for providing combined protection from the risk of electrocution and protection against the risk of an electrical fire and overcurrent protection of equipment and cables. A typical conventional eRCBO is of a size of approximately 125 mm in height, 18 mm in width and 70 mm deep.

The housing is multi-sectional and includes an interior wall dividing the space within the housing to provide equal or unequal distribution of the space within the eRCBO. Space constraints may affect the functionality of the devices provided within the housing. Therefore, optimized space allocation within the circuit breaker is desired.

BRIEF DESCRIPTION OF THE INVENTION

According to one aspect of the invention, a single pole module of a circuit breaker is disclosed. The single pole module includes a first portion having a first current path region, a second portion adjacent to the first portion having a second current path region, an interior wall separating the first portion from the second portion. The first portion of the single pole module comprising a first section configured to receive a circuit board and a second section configured to receive a lever mechanism. The second portion of the single pole module comprising a first section configured to receive an electromagnetic protection device, a second section configured to receive an arc extinguishing device, a third section configured to receive a thermal protection device, and a fourth section configured to receive an operating mechanism of the circuit breaker. The first and second sections of the first portion occupy substantially half of the single pole module and the first, second, third and fourth sections of the second portion occupy substantially half of the single pole module and the second section of the first side and the third and fourth sections of the second portion are disposed opposite each other.

According to another aspect of the invention, a circuit breaker is provided. The circuit breaker includes a single pole module of a circuit breaker comprising a first portion including a first current path region and first and second sections and second portion opposite the first portion including a second current path region and first, second, third and fourth sections, the first and second portions being separated by an interior wall, a circuit board comprising a trip solenoid disposed within the first section of the first portion, a lever mechanism in operable communication with the trip solenoid and disposed within the second section of the first portion, the lever mechanism further comprising an end portion configured to be in operable communication with the trip solenoid and actuated by the trip solenoid upon a predetermined electrical condition. The circuit breaker further includes a circuit protection device disposed in the first, second, third and fourth sections of the second portion and a tripping mechanism in operable communication with the circuit protection device and disposed within the third section of the second portion, wherein the lever mechanism is in operable communication with the tripping mechanism and configured to trip the circuit breaker when actuated.

These and other advantages and features will become more apparent from the following description taken in conjunction with the drawings.

BRIEF DESCRIPTION OF THE DRAWING

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
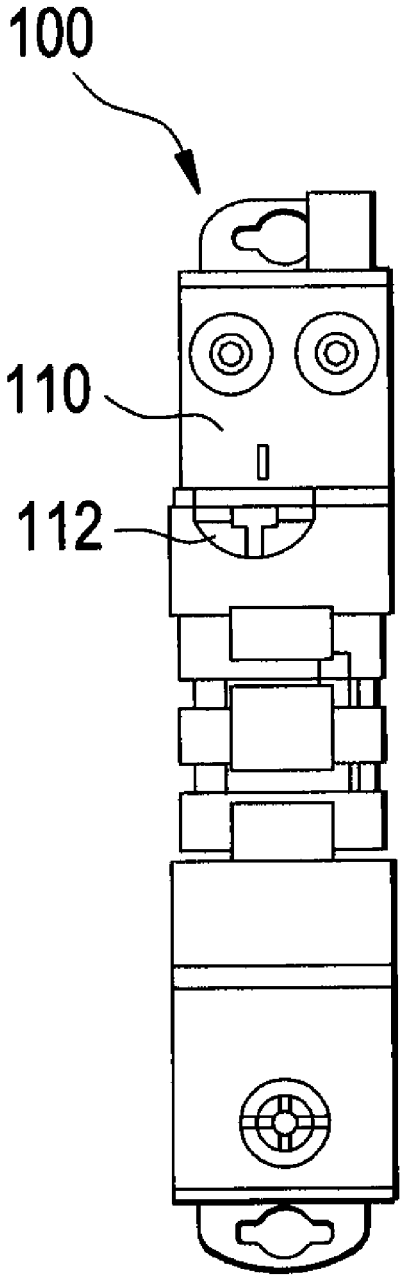
FIG. 1 is a perspective view of a circuit breaker in accordance with an embodiment of the invention.

Referring now to FIG. 1, a circuit breaker 100 for providing overcurrent and short-circuit protection is disclosed. According to an embodiment of the present invention, the circuit breaker 100 has a current rating of approximately 6 to 40 A with a short circuit (SC) capacity of approximately 6 KA, for example. The present invention is not limited to any particular electrical ratings and may vary accordingly. The circuit breaker includes a single pole module 110 and a test assembly 112 arranged to allow a user to simulate a residual current fault situation for performing a test operation of a tripping mechanism of the circuit breaker 100.

Figure 2:
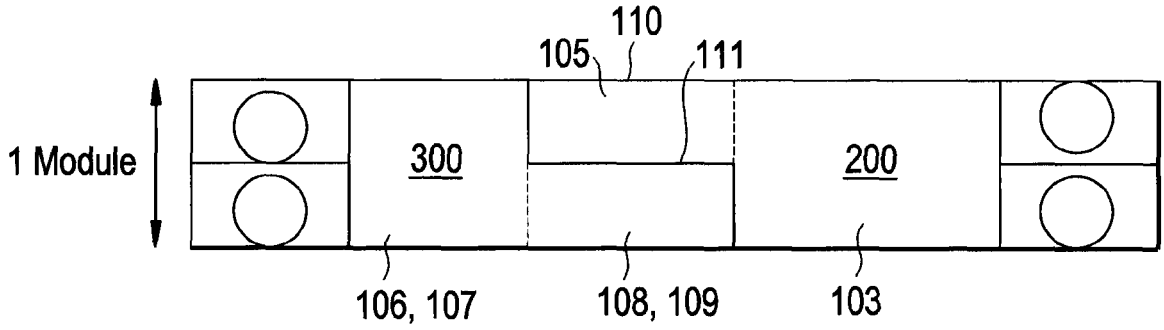
FIG. 2 is an orthographic layout of a module of the circuit breaker in accordance with an embodiment of the present invention.

FIG. 2 is an orthographic layout of a module of the circuit breaker in accordance with an embodiment of the present invention. As shown in FIG. 2, the single pole module 110 is approximately 86 mm in height, 18 mm in width and 70 mm in depth, for example. The module 110 of the present invention is not limited to any particular dimensions and may vary accordingly. The module 110 includes an interior wall 111 (as depicted in FIG. 2), which divides the space within the circuit breaker 100 and serves as a shell or frame onto which components of the circuit breaker 100 are disposed. Details regarding the module 110 will now be described with reference to FIGS. 2 through 6. As shown in FIG. 2, the module 110 includes a first portion (i.e., an RCD side 200) having a first current path region and a second portion (i.e., an MCB pole side 300) adjacent to the second current path region and having a second current path region. The interior wall 111 separates the first portion from the second portion.

Figure 3:
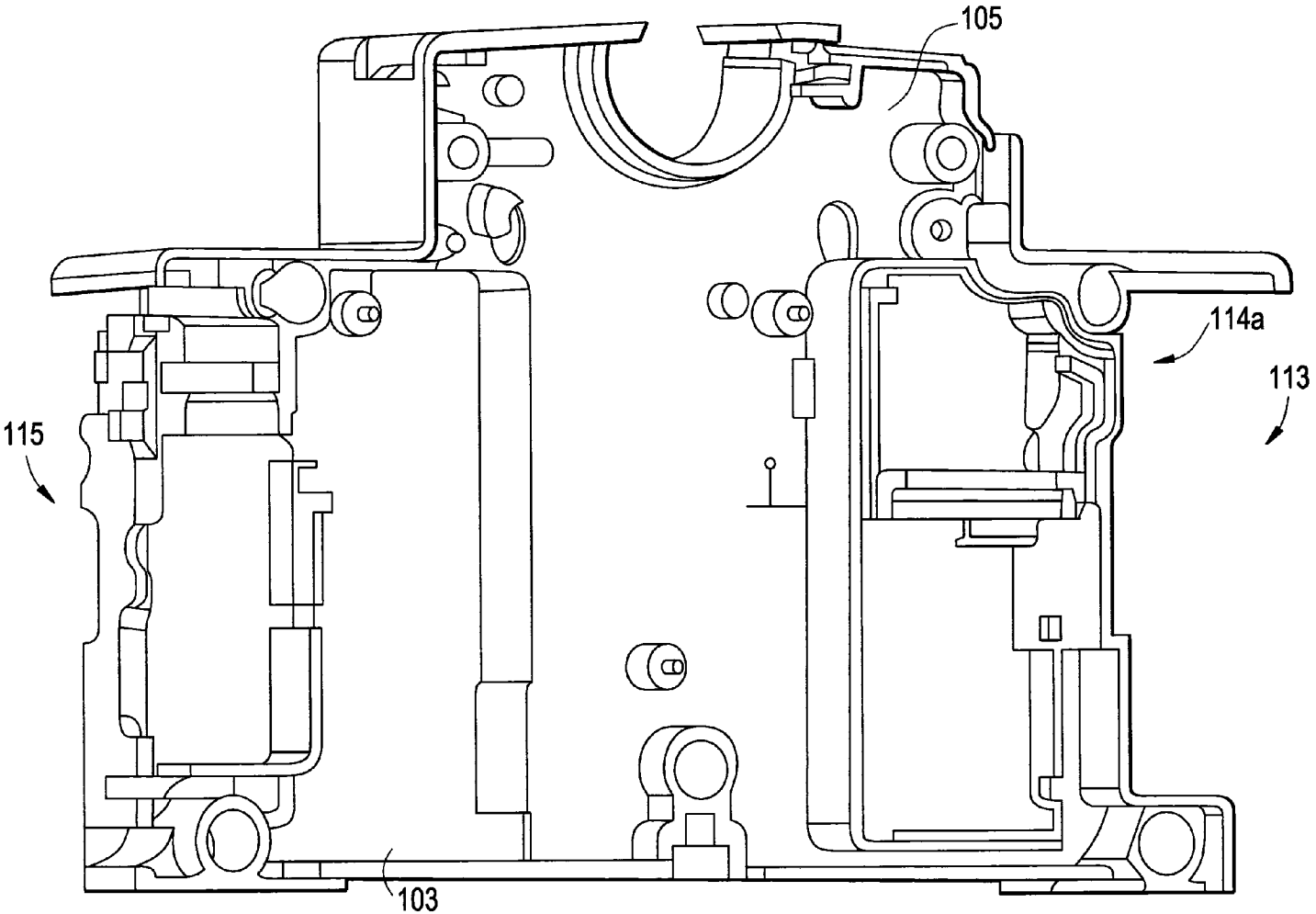
FIG. 3 is a detailed schematic of an RCD side of the module shown in FIG. 2 in accordance with an embodiment of the present invention.
Figure 5:
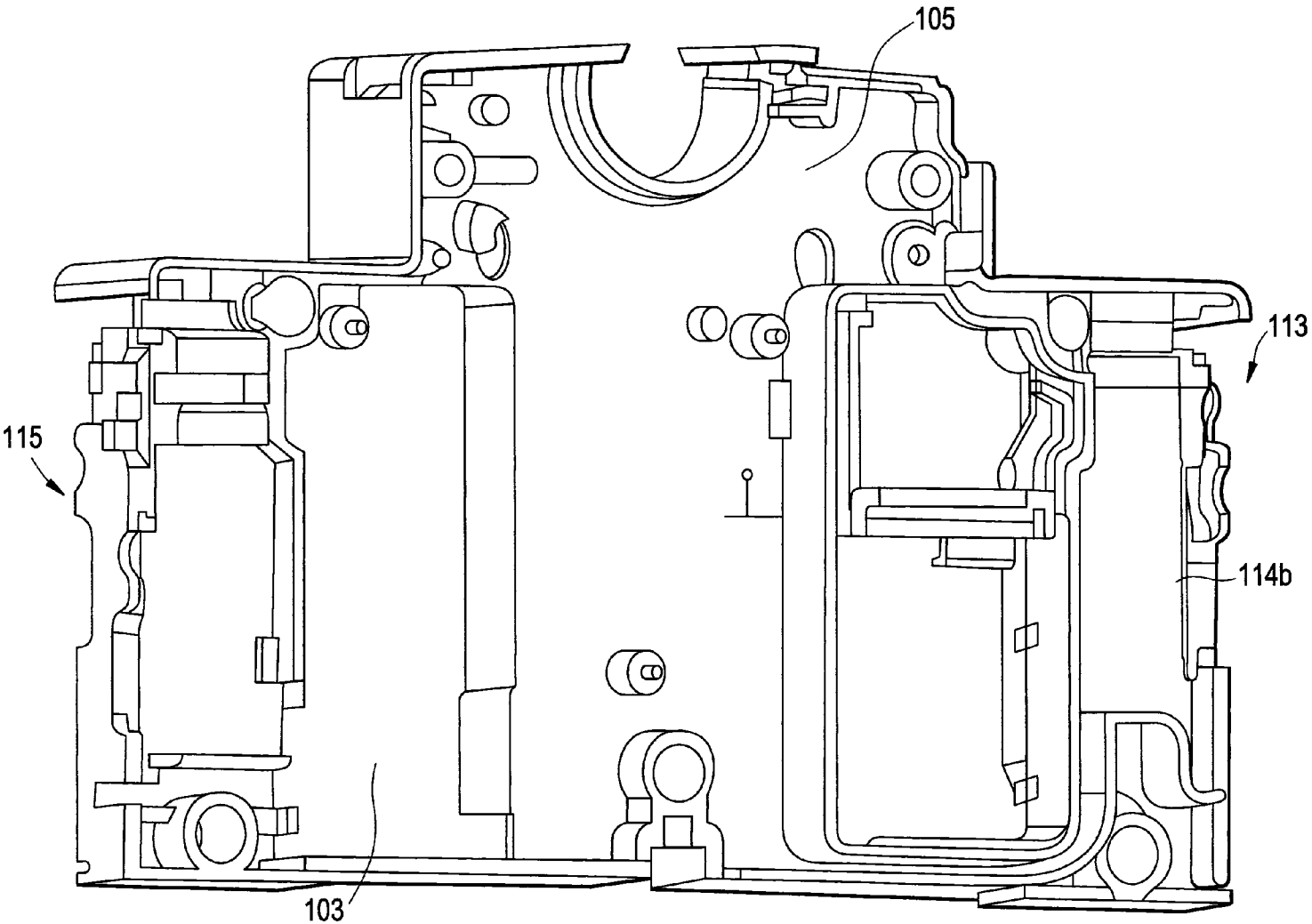
FIG. 5 is a detailed schematic of an RCD side of the module shown in FIG. 2 in accordance with an alternative embodiment of the present invention.
Figure 7:
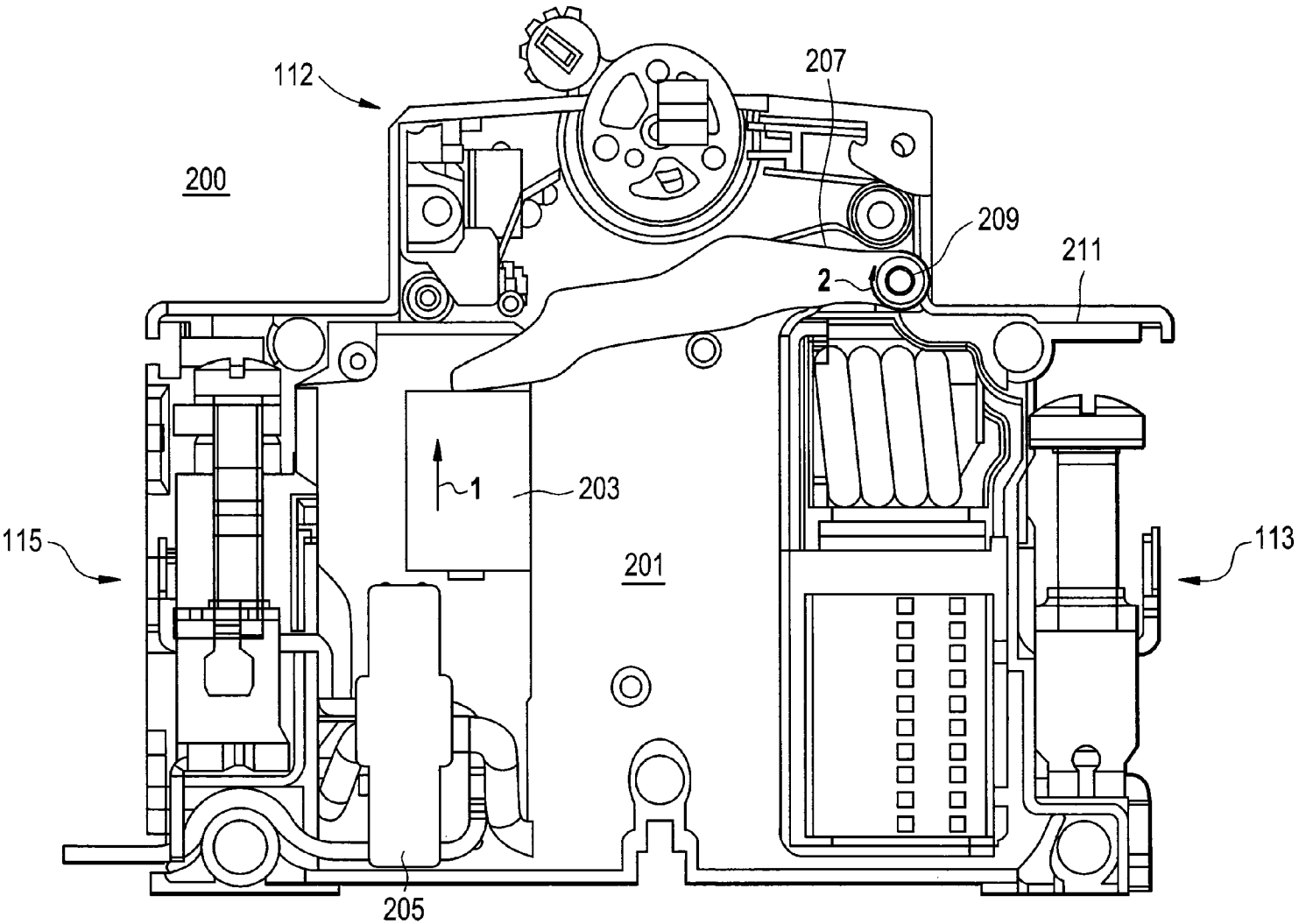
FIG. 7 is a schematic diagram illustrating the RCD side of the circuit breaker shown in FIG. 1 in accordance with an embodiment of the present invention.

According to an embodiment of the present invention, in FIGS. 2, 3 and 5, the RCD side 200 of the module 110 includes a first section 103 configured to receive a printed circuit board 201 (as depicted in FIG. 7) and a second section 105 configured to receive a lever mechanism 207 (as depicted in FIG. 7). The lever mechanism 207 is in operable communication with the PCB 201 to perform a trip operation of the circuit breaker 100. Additional details regarding the operation of the lever mechanism 207 will be discussed below with reference to FIGS. 7 through 9.

Figure 4:
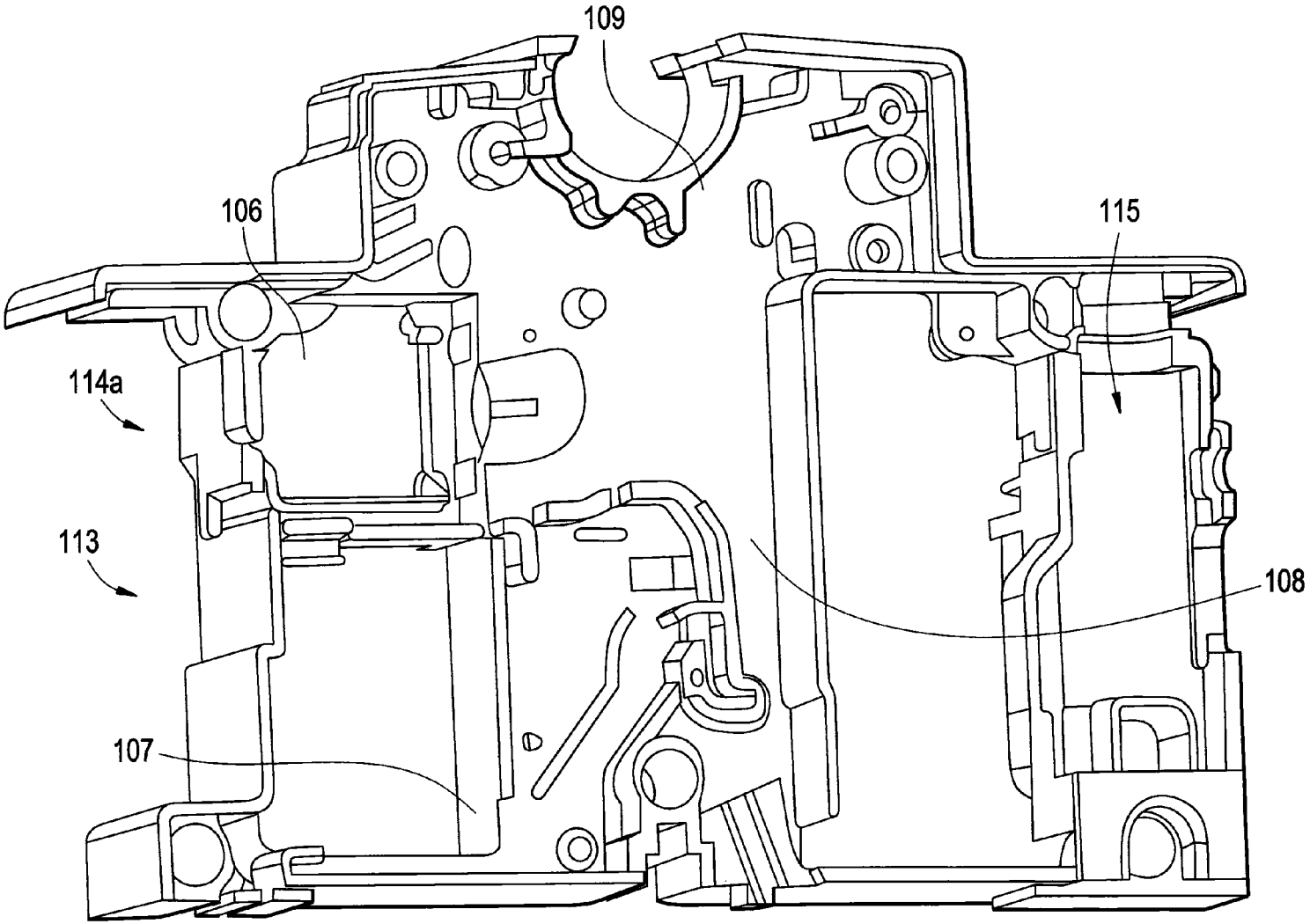
FIG. 4 is a detailed schematic of an MCB pole side of the module shown in FIG. 2 in accordance with an embodiment of the present invention.
Figure 6:
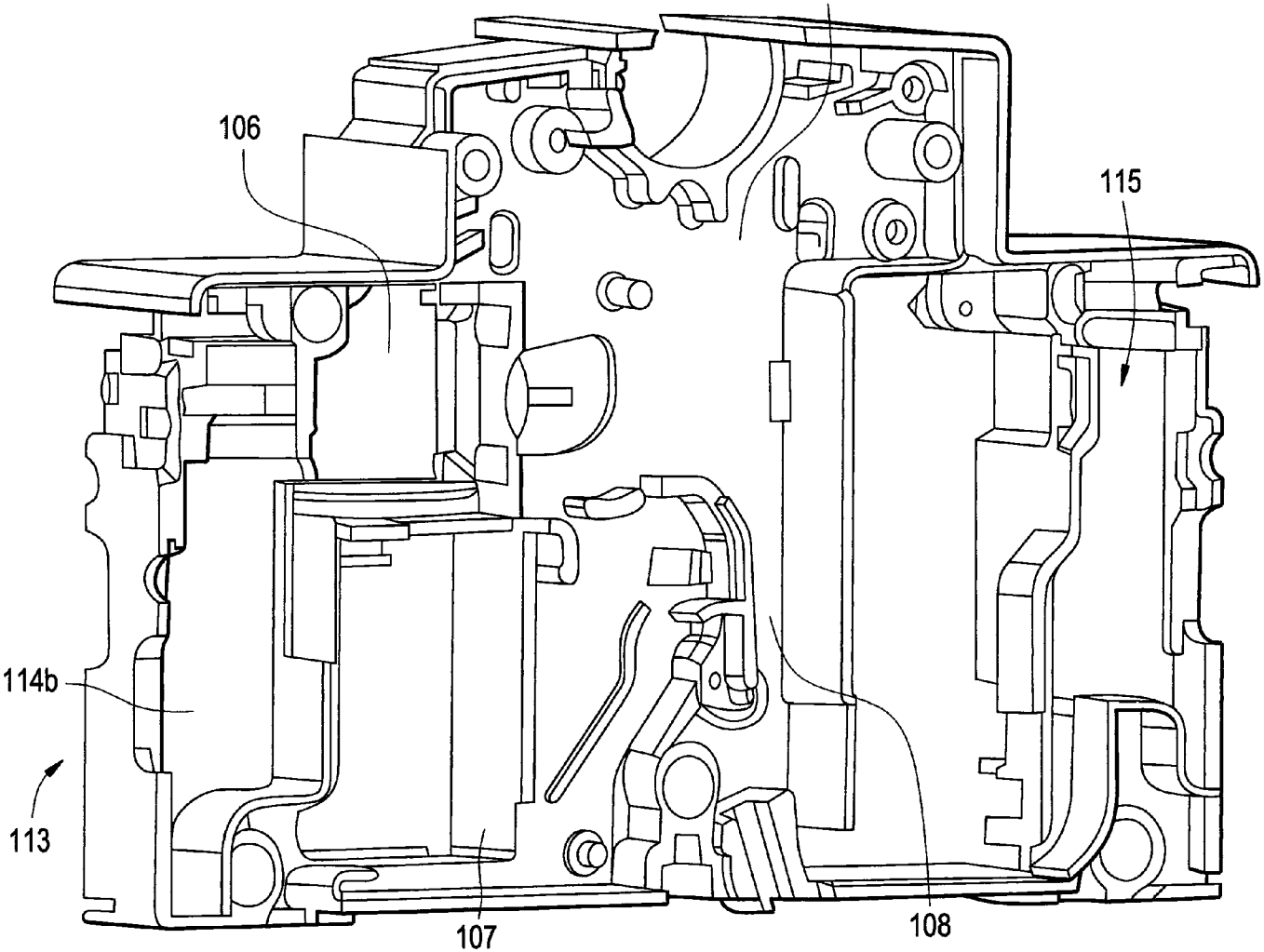
FIG. 6 is a detailed schematic of an MCB pole side of the module shown in FIG. 2 in accordance with an alternative embodiment of the present invention.
Figure 9:
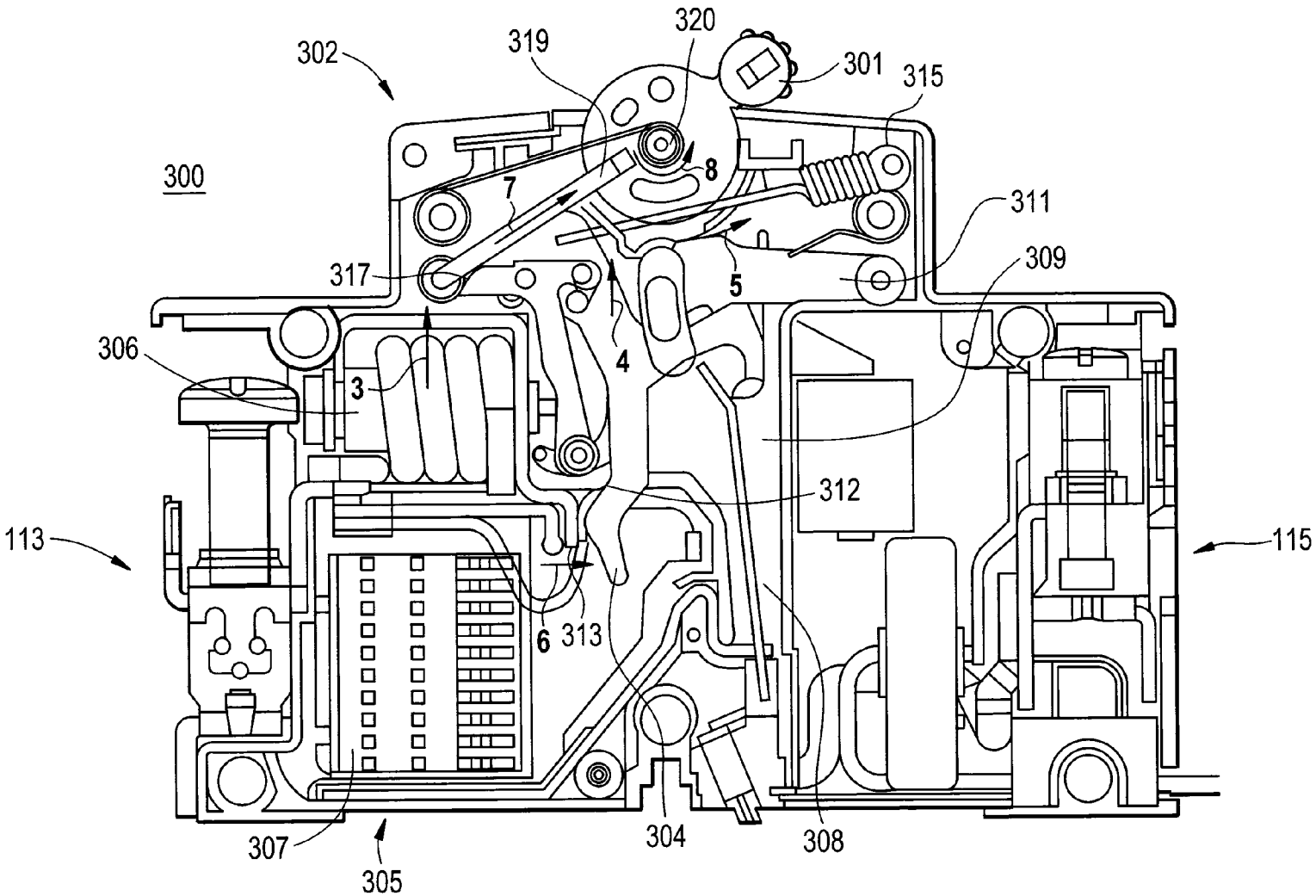
FIG. 9 is schematic diagram illustrating an MCB pole side of the circuit breaker shown in FIG. 1 in accordance with an embodiment of the present invention.

According to an embodiment of the present invention, in FIGS. 2, 4 and 6, the MCB pole side 300 of the module 110 includes a first section 106 configured to receive an electromagnetic protection device 306 (as depicted in FIG. 9), a second section 107 configured to receive an arc distinguishing device 307 (as depicted in FIG. 9), a third section 108 configured to receive a thermal protection device 308 (as depicted in FIG. 9), and a fourth section 109 configured to receive an operating mechanism 302 (as depicted in FIG. 9).

Referring back to FIG. 2, according to an embodiment of the present invention, the first section 103 and the second section 105 of the RCD side 200 occupy substantially half of the module 110 and the first section 106, the second section 107, the third section 108 and the fourth section 109 of the MCB pole side 300 occupy substantially half of the module 110. The second section 105 of the RCD side 200 and the third and fourth sections 108 and 109 of the MCB pole side 300 are disposed opposite each other. Further, the second section 105 of the RCD side 200 and the third and fourth sections 108 and 109 of the MCB pole side 300 are also centrally disposed within the module 110 relative to a length of the module 110.

According to an embodiment of the present invention, the first section 103 of the RCD side 200 and the first and second sections 106 and 107 of the MCB pole side 300 together occupy a substantial part of an internal width of the module 110. Further, the first section 103 of the RCD side 200 is disposed at an opposite end relative to the length of the module 110 from the first and second sections 106 and 107 of the MCB pole side 300. In addition, as shown in FIG. 2, the second section 105 of the RCD side 200 and the third and fourth sections 108 and 109 of the MCB pole side 300 are disposed in between the first section 103 of the RCD side 200 and the first and second sections 106 and 107 of the MCB pole side 300. As shown, the first portion of the module 110 which houses the RCD side 200 forms an L-shape and the second portion of the module 110 forms an L-shape. The first portion and the second portion comprise substantially total area of the module 110.

As further shown in FIGS. 3 through 6, the module 110 includes a first circuit connection portion 113 and a second connection portion 115. As shown in FIGS. 3 and 4 according to an embodiment of the present invention, the first circuit connection portion 113 includes an open portion 114*a* adjacent to the first section 106 of the MCB pole side 300 and is configured to receive a phase conductor of the circuit breaker 100. As shown in FIGS. 5 and 6, according to another embodiment of the present invention, the module 110 includes a molded enclosure 114*b* configured to receive a phase conductor of the circuit breaker 100. Additional details regarding the first and second circuit connection portions 113 and 115 will be discussed below.

According to an embodiment of the present invention, the RCD side 200 is arranged on one side for use in conjunction with the MCB pole side 300. Details regarding the RCD side 200 and the MCB pole side 300 will now be described below in reference to FIGS. 7 and 9.

FIG. 7 is a schematic diagram illustrating the RCD side 200 of the circuit breaker 100. According to an embodiment of the present invention, as shown in FIG. 7, the RCD side 200 includes a printed circuit board (PCB) 201 having a trip solenoid 203 disposed within the first section 103 of the module 110. The PCB 201 further includes a current transformer 205 along with other electrical and electronic components. The current transformer 205 monitors current flow in the circuit breaker 100. The PCB 201 is housed within the first portion of the single pole module 110. The PCB 201 is centrally disposed relative to the height of the circuit breaker 100. According to an embodiment of the present invention, the trip solenoid 203 includes an elongated body and is mounted within the PCB 201 such that a length of the elongated body is aligned with the depth of the single pole module 110. As shown in FIG. 3, the current transformer 205 straddles the PCB 201 at an end portion of the PCB 201 opposite that of the trip solenoid 203. The present invention is not limited to any particular arrangement of the trip solenoid 203 and the current transformer 205, and may vary as necessary. Alternative embodiments will be discussed below with reference to FIGS. 12 and 15.

According to an embodiment of the present invention, the RCD side 200 further includes a lever mechanism 207 in operable communication with the trip solenoid 203. The lever mechanism 207 includes an end portion configured to be in operable communication with the trip solenoid 203. According to an embodiment of the present invention, the lever mechanism 207 is disposed at a center portion of the module 110 adjacent to test assembly 112.

Figure 8:
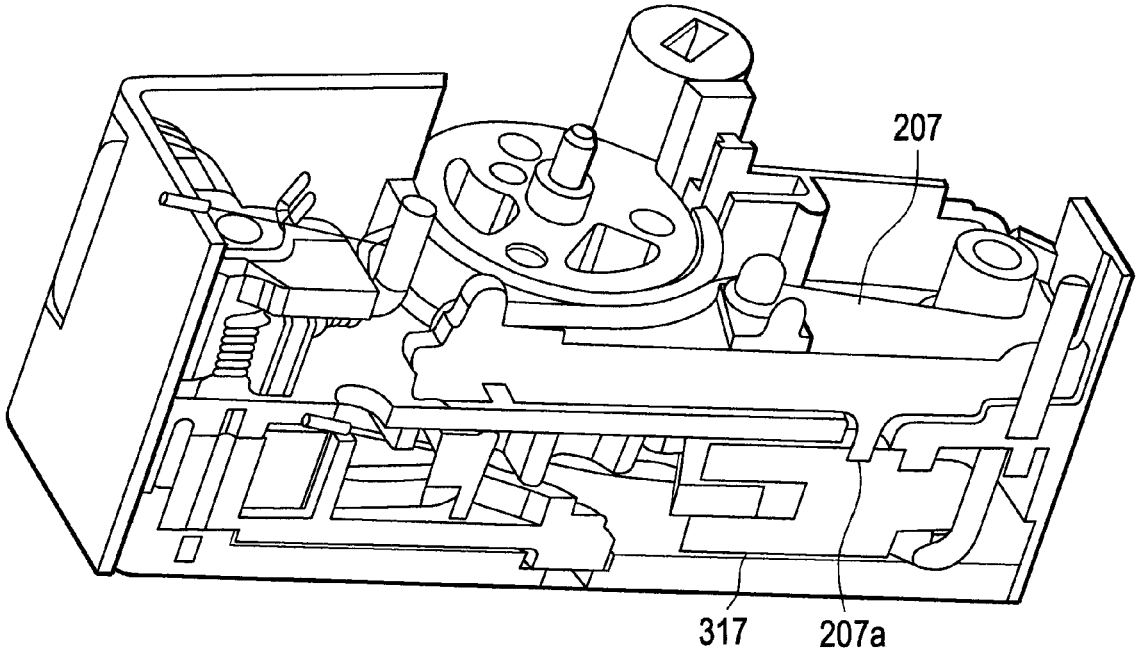
FIG. 8 is a perspective view illustrating the lever mechanism shown in FIG. 4 in accordance with an embodiment of the present invention.

FIG. 8 is a perspective view illustrating the lever mechanism 207 shown in FIG. 7 in accordance with an embodiment of the present invention. As shown in FIG. 7, the lever mechanism 207 includes a pin 207*a* on a side thereof facing the interior wall 111 and inserted through the interior wall 111 to extend to the other side (i.e., the MCB pole side 300) of the circuit breaker 100. The pin 207*a* interfaces with an activator 317 disposed on the MCB pole side 300 (as depicted in FIG. 9). Additional details regarding the interface between the lever mechanism 207 and the activator 317 will be discussed below.

Referring back to FIG. 7, the single pole module 110 further includes end portions at each end for circuit connections. The first circuit connection portion 113 is adjacent to a circuit protection device 305 (as depicted in FIG. 9) and the second terminal portion 115 is adjacent to the PCB 201. According to an embodiment of the present invention, first and second circuit connection portions 113 and 115 are screw-operated terminals. However, the present invention is not limited hereto and may vary accordingly. Additional details regarding the first and second circuit connection portions 113 and 115 will be described below with reference to FIGS. 10 through 15.

An operation of the circuit breaker 100 will now be described with reference to FIGS. 7 and 9. When a predetermined electrical condition occurs, for example, a predetermined amount of residual current excites the PCB 201, a solenoid plunger (not shown) of the trip solenoid 203 moves in a direction as indicated by arrow 1, and the lever mechanism 207 is actuated by the trip solenoid 203. The lever mechanism 207 rotates in a clockwise direction about a pin 209 (as indicated by arrow 2). According to an embodiment of the present invention, the lever mechanism 207 acts as an interface between the RCD side 200 and the MCB pole side 300 to enable a trip operation of the circuit breaker 100. Additional details regarding the operation of the lever mechanism 207 and its interface to the MCB pole side 300 will be discussed below with reference to FIG. 9.

FIG. 9 is a schematic diagram illustrating the MCB pole side 300 of the circuit breaker 100 according to an embodiment of the present invention. As shown in FIG. 4, a toggle lever 301 is in mechanical communication with an operating mechanism 302 to control the position of a movable contact arm 304. As previously mentioned above, the operating mechanism 302 is disposed in the fourth section 109 of the MCB pole side 300 of the module 110. A circuit protection device 305 is also provided. Further, a tripping mechanism 309 in operable communication with the circuit protection device 305 is also provided for tripping the circuit breaker 100. The circuit protection device 305 includes an electromagnetic protection device 306 (i.e., a coil) for short circuit protection, an arc distinguishing device 307 to extinguish arcs created during the trip operation of the circuit breaker 100 and a thermal protection device 308 for over current protection.

As previously mentioned above, the electromagnetic protection device 306 is disposed in the first section 106, the arc distinguishing device 307 is disposed in the second section 107, and the thermal protection device 308 is disposed in the third section 108 of the MCB pole side 300. The MCB pole side 300 further includes an external tripping lever 311. In FIG. 4, the movable contact arm 304 is shown in a "closed" position, which corresponds to an "on" position of the toggle lever 301, to allow the current to flow through the circuit breaker 100. Current flows from a fixed contact 312 to a movable contact 313 disposed on the movable contact arm 304. A spring 315 is connected with a second end 116*b* of the axle 116 and is in operable communication with the movable contact arm 304. The activator 317 is in operable communication with the lever mechanism 207 (as depicted in FIG. 7). As mentioned above, the lever mechanism 207 includes a pin 207*a* (as depicted on FIG. 8) on a side thereof which extends through the interior wall 111 onto the MCB pole side 300. As shown in FIG. 8, the pin 207*a* of the lever mechanism 207 contacts the activator 317. Referring back to FIG. 7, a clockwise rotation of the lever mechanism 207 causes the activator 317 to move in a direction as indicated by arrow 3. A hook 318 of the activator 317 is then released (as indicated by the arrow 4) and a bias force is then applied to the spring 315 to return it to a relaxed position (as indicated by arrow 5) which in turn causes the movable contact arm 304 to rotate in a counterclockwise direction to separate the fixed contact 312 and the movable contact 313 (as indicated by arrow 6). As a result, a link 319 of the operating mechanism 302 moves in a direction as indicated by arrow 7, thereby causing the toggle lever 301 to rotate about a pivot 320 in a counterclockwise direction (as indicated by arrow 8) and tripping the circuit breaker 100. As described above, the RCD side 200 and MCB pole side 300 of the circuit breaker 100 are disposed within the single pole module 110. Therefore, there are various circuit breaker connection arrangements according to embodiments of the present invention, which may be accommodated within the circuit breaker 100. The circuit breaker connection arrangements will now be described below with reference to FIGS. 10 through 16.

Figure 10:
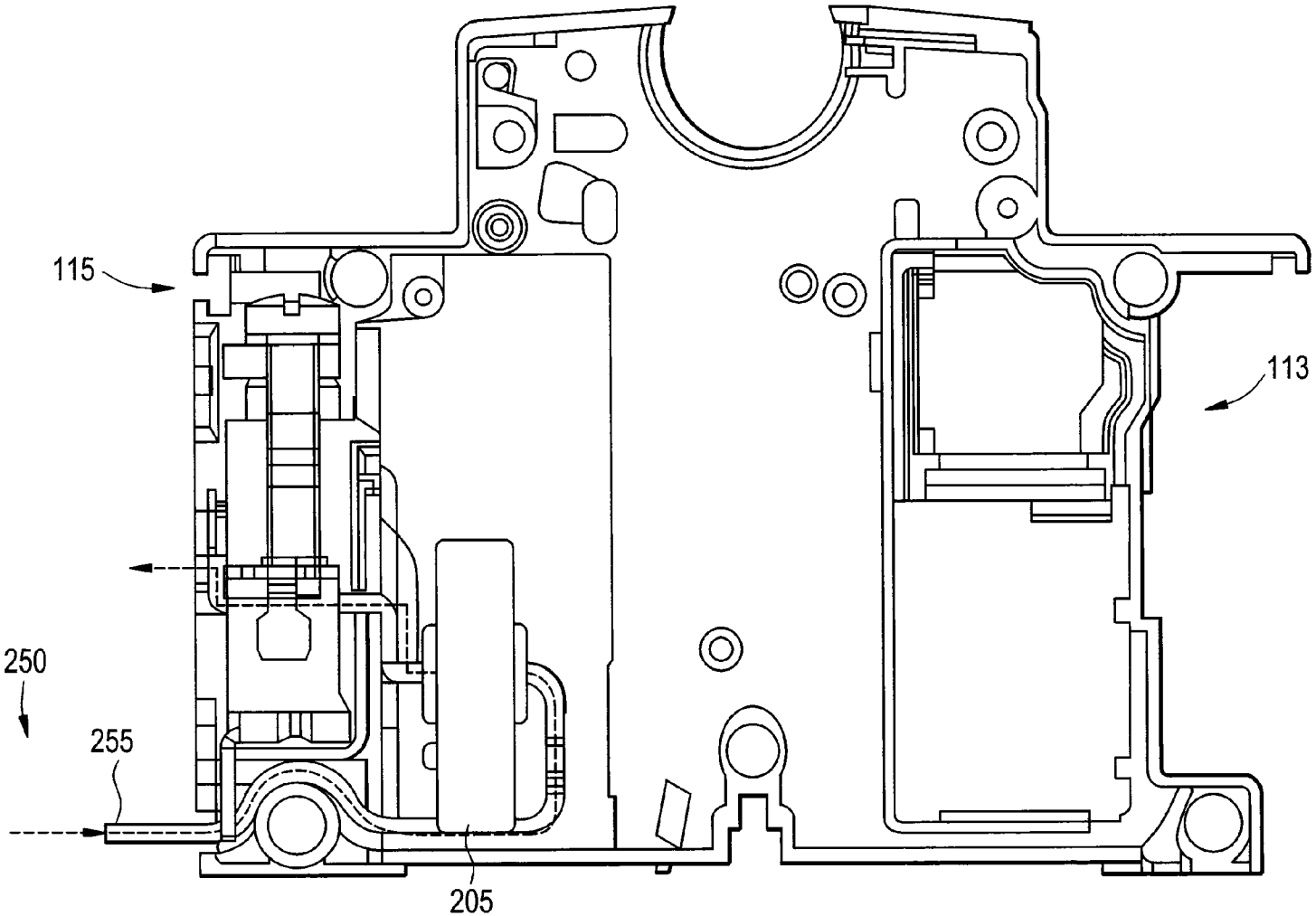
FIG. 10 is a schematic diagram illustrating a circuit breaker connection arrangement on the RCD side of the circuit breaker in accordance with an embodiment of the present invention.

FIG. 10 is a schematic diagram illustrating a circuit breaker connection arrangement of the circuit breaker 100 in accordance with one embodiment of the present invention. In FIG. 10, a first current path region 250 (as indicated by a dotted line) is provided. The first current path region 250 includes a neutral conductor 255 at the second circuit connection portion 115, and a side portion and a center portion of the current transformer 205. As shown in FIG. 10, in the first current path region 250, the current flows between the second circuit connection portion 115 and the side portion and the center portion of the current transformer 205.

Figure 11:
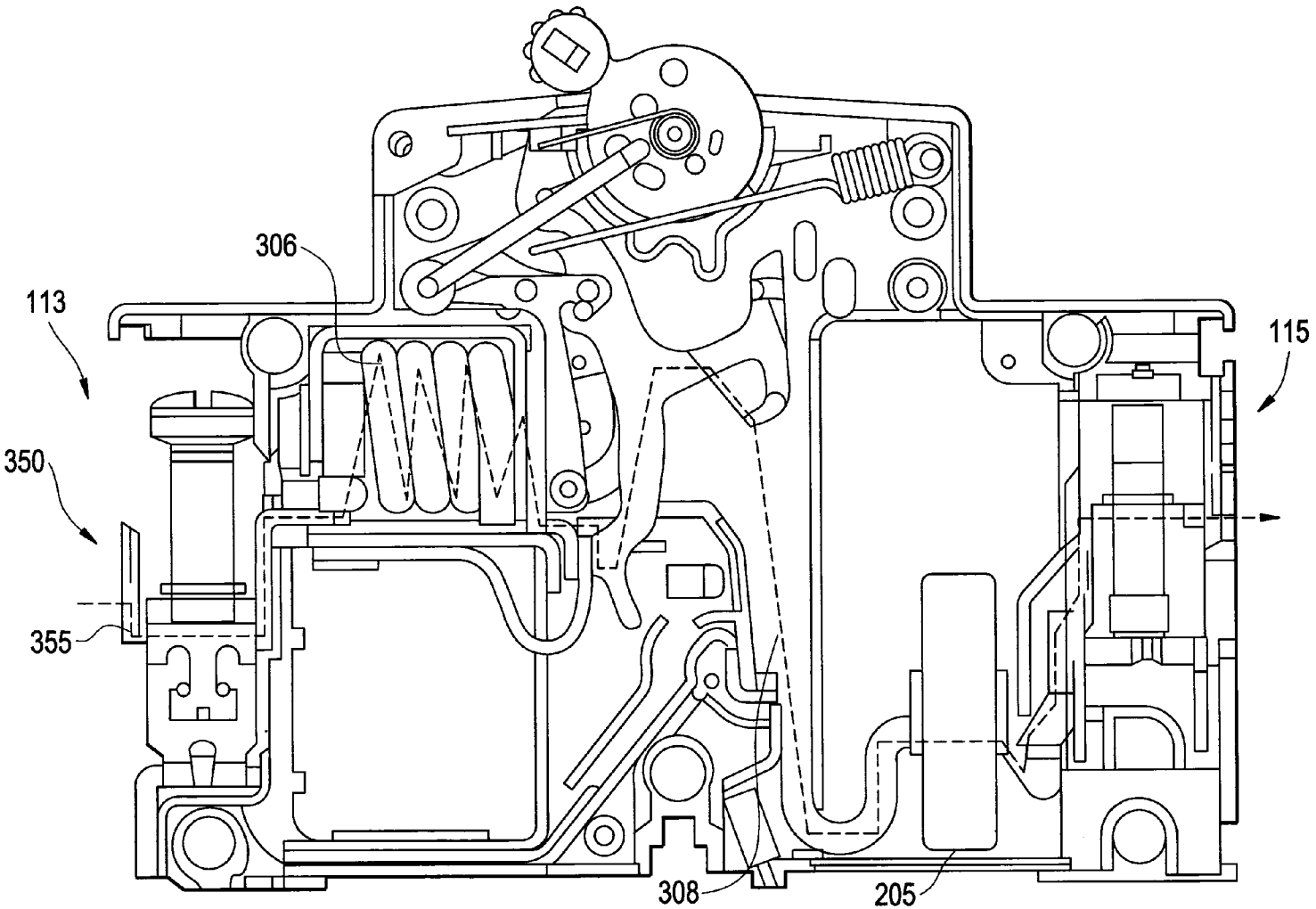
FIG. 11 is a schematic diagram illustrating circuit breaker connection arrangement on the MCB pole side of the circuit breaker in accordance with an embodiment of the present invention.

As shown in FIG. 11, according to this embodiment of the present invention, a second current path region 350, (as indicated by a dotted line) is provided. The second current path region 350 includes a line conductor 355 at the first circuit connection portion 113, the electromagnetic protection device 306, the thermal protection device 308 and the center portion of the current transformer 205. As shown in FIG. 11, in the second current path region 350, current flows between the first circuit connection portion 113, the electromagnetic protection device 306, the thermal protection device 308, the center portion of the current transformer 205 and the second circuit connection portion 115. Embodiments of the circuit breaker connection arrangement of the circuit breaker 100 will now be described below with reference to FIGS. 11 through 16.

Figure 12:
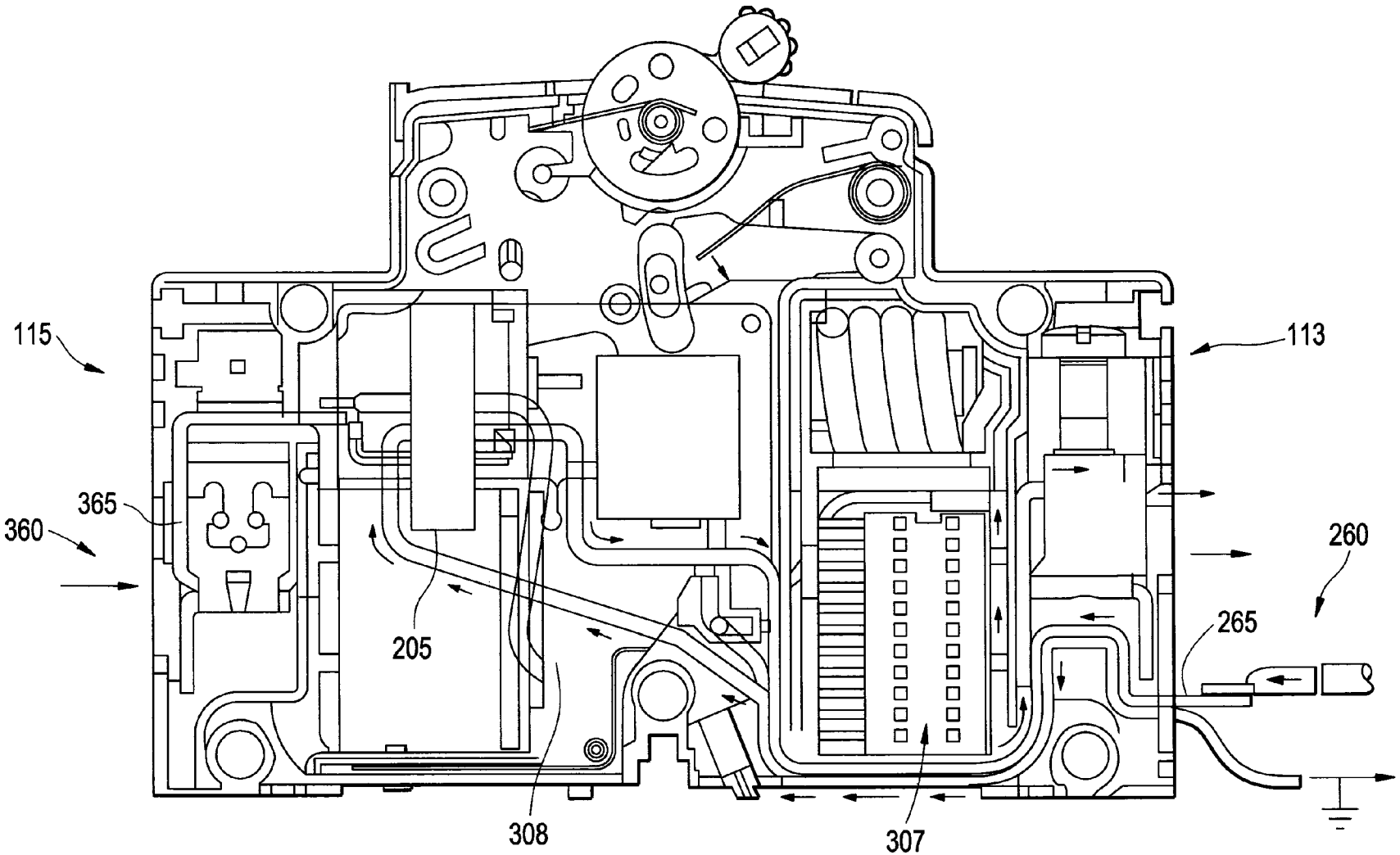
FIG. 12 is a schematic diagram illustrating a circuit breaker connection arrangement in accordance with an alternative embodiment of the present invention.

FIG. 12 is a schematic diagram illustrating a circuit breaker connection arrangement of the circuit breaker 100 in accordance with an alternative embodiment of the present invention. In FIG. 12, a first current path region 260 is provided. The first current path region 260 includes a neutral conductor 265 at the first circuit connection portion 113, a side portion of the arc distinguishing device 307 and the center portion of the current transformer 205. As shown in FIG. 12, in the first current path region 260, the current flows between the first circuit connection portion 113, the side portion of the arc distinguishing device 307 and the center portion of the current transformer 205 Further, according to this embodiment of the present invention, a second current path region 360 is provided. The second current path region 360 includes the first circuit connection portion 113, a line conductor 365 at the second circuit connection portion 115, the center portion of the current transformer 205 and the thermal protection device 308. As shown in FIG. 12, in the second current path region 360, the current flows between the first circuit connection portion 113, the center portion of the current transformer 205, the thermal protection device 308 and the second circuit connection portion 115. As shown in FIG. 6, the current transformer 205 is aligned adjacent to the trip solenoid 203 according to this embodiment of the present invention.

Figure 13:
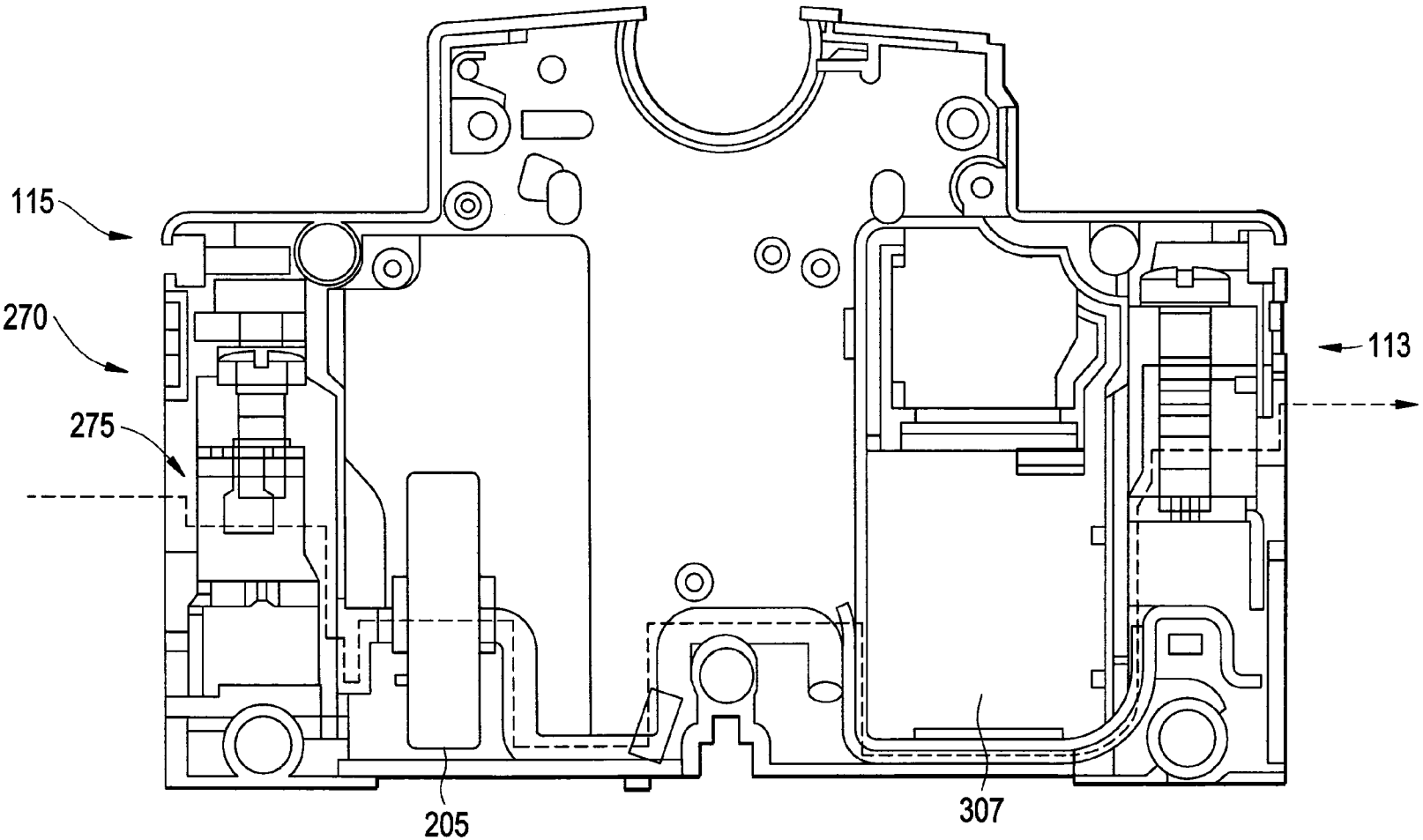
FIG. 13 is a schematic diagram illustrating a circuit breaker connection arrangement on the RCD side of the circuit breaker in accordance with an alternative embodiment of the present invention.
Figure 14:
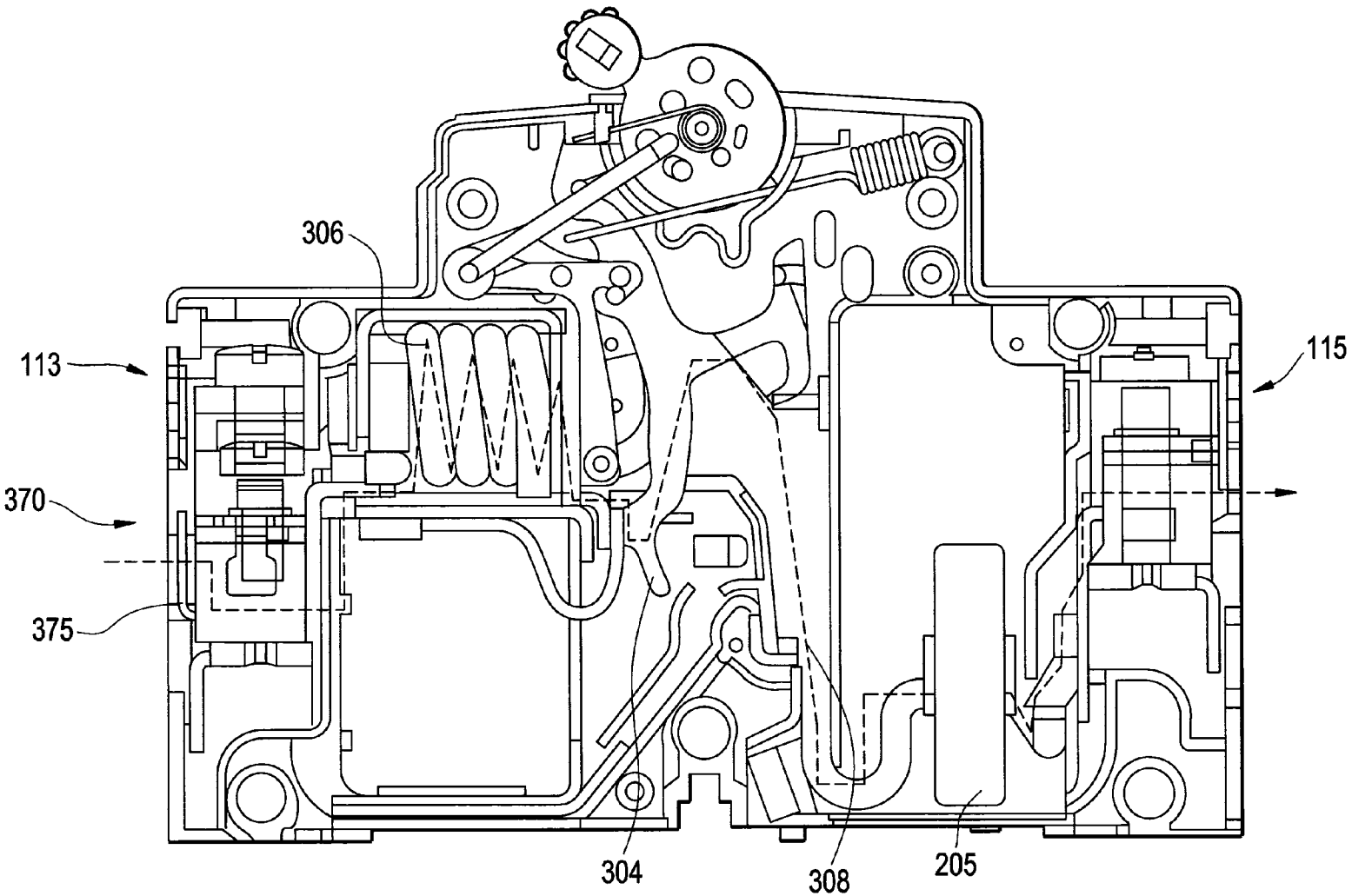
FIG. 14 is a schematic diagram illustrating a circuit breaker connection arrangement on the MCB pole side of the circuit breaker in accordance with an alternative embodiment of the present invention.

FIGS. 13 and 14 are schematic diagrams illustrating a circuit breaker connection arrangement of the circuit breaker 100 in accordance with yet another embodiment of the present invention. In FIG. 13, a first current path region 270 (as indicated by the dotted line) is provided. The first current path region 270 includes the first circuit connection portion 113, a neutral conductor 275 at the second circuit connection portion 115, the center portion of the current transformer 205 and a side portion of the arc distinguishing device 307. As shown in FIG. 13, in the first current path region 270, current flows between the first circuit connection portion 113, the center portion of the current transformer 205, the side portion of the arc distinguishing device 307 and the second circuit connection portion 115. In FIG. 14, according to an embodiment of the present invention, a second current path region 370 (as indicated by the dotted line) is provided. The second current path region 370 includes a line conductor 375 at the first circuit connection portion 113, the electromagnetic protection device 306, the movable contact arm 304, the thermal protection device 308, the center portion of the current transformer 205 and the second circuit connection portion 115. As shown in FIG. 14, in the second current path region 370, current flows between the first circuit connection portion 113, the electromagnetic protection device 306, the movable contact arm 304, the thermal protection device 308, the center portion of the current transformer 205 and the second circuit connection portion 115.

Figure 15:
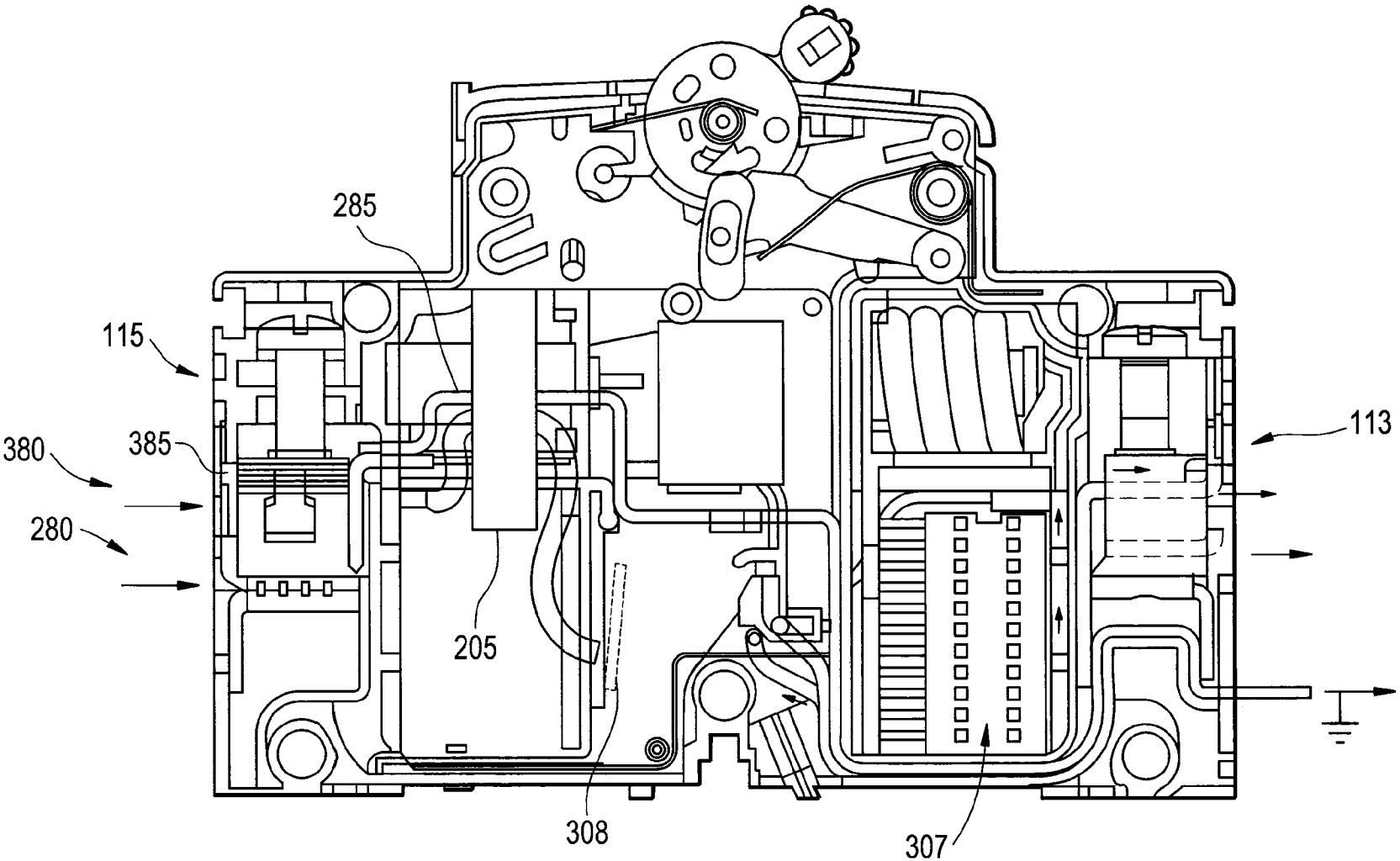
FIG. 15 is a schematic diagram illustrating circuit breaker connection arrangement in accordance with an alternative embodiment of the present invention.

FIG. 15 is a schematic diagram illustrating a circuit breaker connection arrangement according to yet another embodiment of the present invention. As shown in FIG. 15, a first current path region 280 is provided. The first current path region 280 includes the first circuit connection portion 113, a neutral conductor 285 at the second circuit connection portion 115, the center portion of the current transformer 205 and a side portion of the arc distinguishing device 307. As shown in FIG. 15, in the first current path region 280, current flows between the first circuit connection portion 113, the center portion of the current transformer 205, the side of the arc distinguishing device 307 and the second circuit connection portion 115. Also shown, in a second current path region 380 is provided. The second current path region 380 includes the first circuit connection portion 113, a line conductor 385 at the second circuit connection portion 115, the center portion of the current transformer 205, the thermal protection device 308 and the side portion of the arc distinguishing device 307. As shown in FIG. 15, in the second current path region 380, the current flows between the first circuit connection portion 113, the center portion of the current transformer 205, the thermal protection device 308, the side of the arc distinguishing device 307 and the second circuit connection portion 115.

Figure 16:
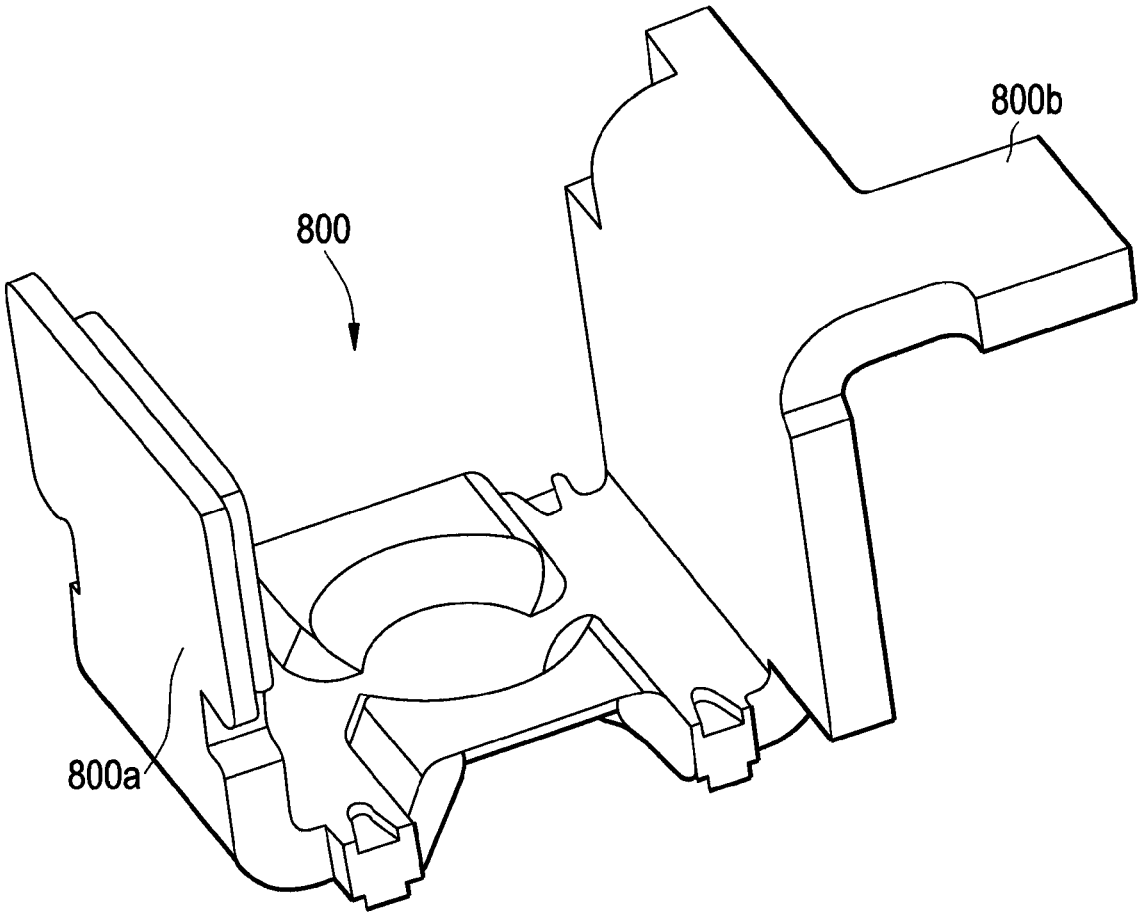
FIG. 16 is a detailed schematic diagram of a phase conductor in accordance with an embodiment of the present invention.
Figure 17:
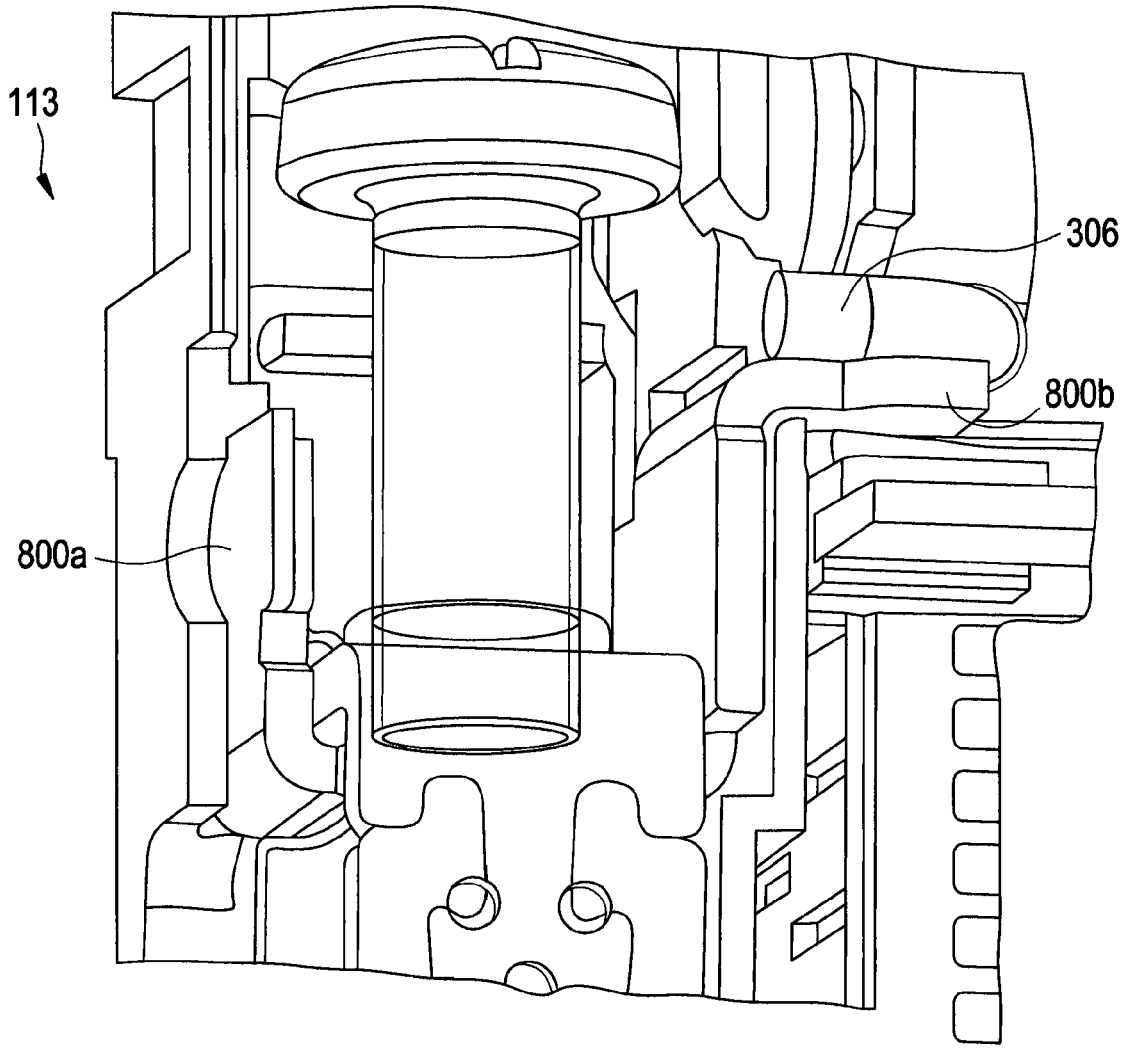
FIG. 17 is a schematic diagram of the phase conductor within the circuit breaker shown in FIG. 1 in accordance with an embodiment of the present invention.

FIG. 16 is a diagram illustrating a phase conductor in accordance with an embodiment of the present invention. As shown in FIG. 16, the phase conductor 800 is formed in a U-shape and includes a first end portion **800*a* and a second end portion 800*b*, the second end portion 800*b* further including a surface configured to electrically connect with the electromagnetic device 306. FIG. 17 is a diagram illustrating the phase conductor shown in FIG. 16 disposed within the circuit breaker 100 in accordance with an embodiment of the present invention. As shown in FIG. 17, in the circuit breaker 100, the first end portion 800*a* extends out of the first circuit connection portion 113 and the second end 800*b* is in power connection with the electromagnetic device 306**.

Figure 18:
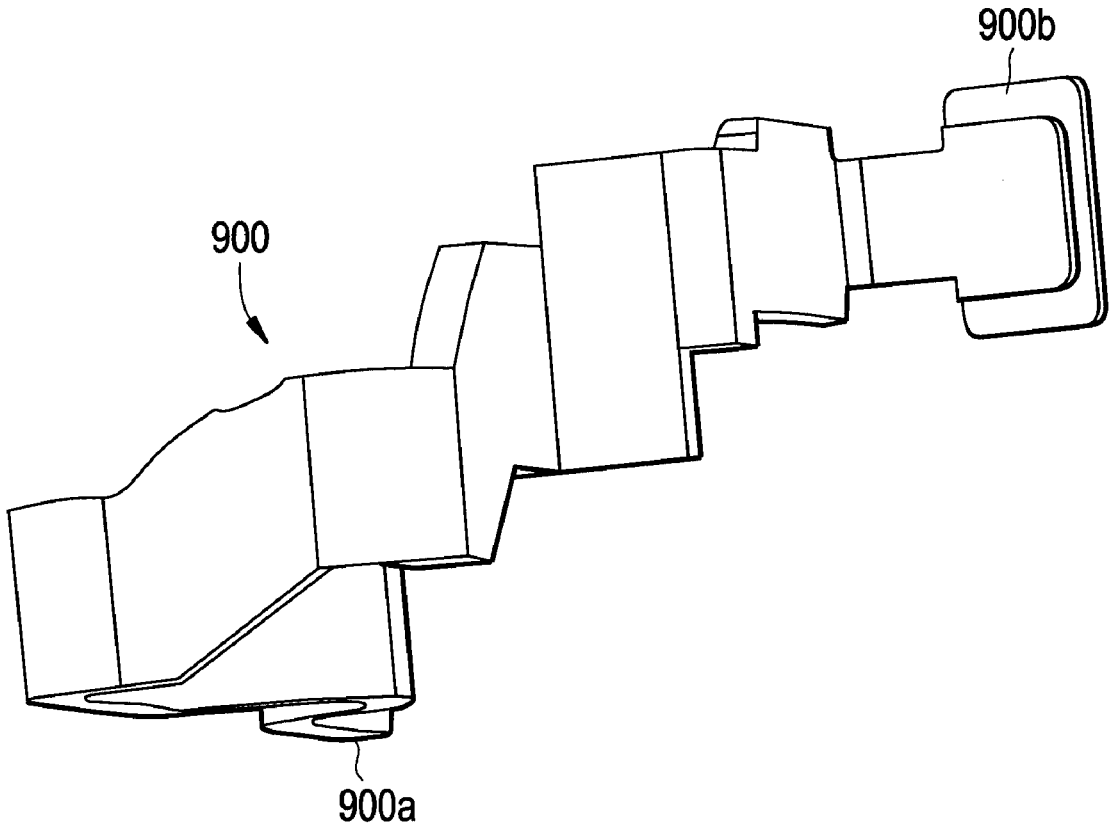
FIG. 18 is a detailed schematic diagram of a flying neutral conductor in accordance with an embodiment of the present invention.
Figure 19:
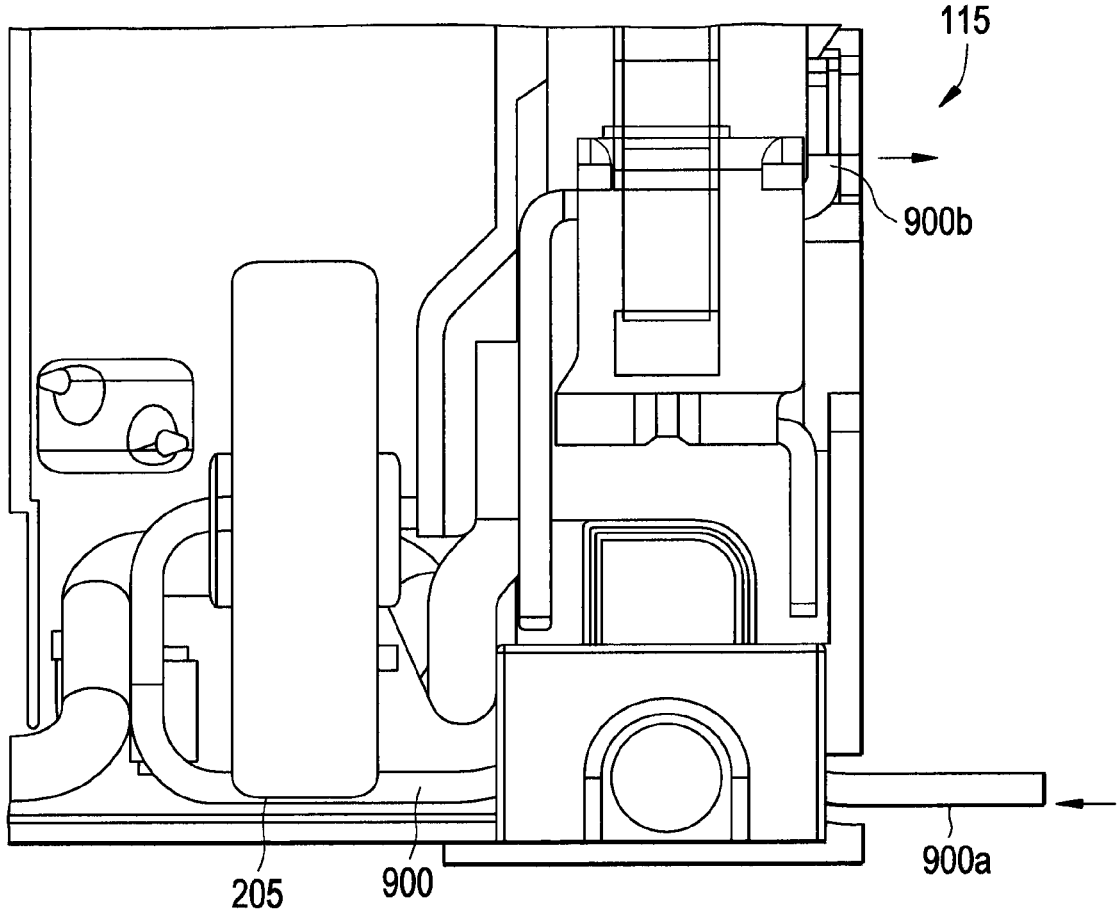
FIG. 19 is a detailed schematic diagram of the flying neutral conductor as shown on the MCB pole side of the circuit breaker in accordance with an embodiment of the present invention.

FIG. 18 is a diagram illustrating a flying neutral conductor of the circuit breaker 100 in accordance with an embodiment of the present invention. As shown in FIG. 10, the flying neutral conductor 900 includes a first end portion **900*a* and a second end portion 900*b*. FIG. 19 is a diagram illustrating the flying neutral conductor 900 shown in FIG. 18, from the MCB pole side 300 of the circuit breaker 100 in accordance with an embodiment of the present invention. In FIG. 19, the flying neutral conductor 900 is referred to as "flying" since the first end portion 900*a* extends from the second circuit connection portion 115 and is connected to a neutral bus bar, for example. The flying neutral terminal conductor 900 is configured to extend around a side of the current transformer 205 on the MCB pole side 300 and through the center of the current transformer 205 on the RCD side 200 as described below with reference to FIG. 20**.

Figure 20:
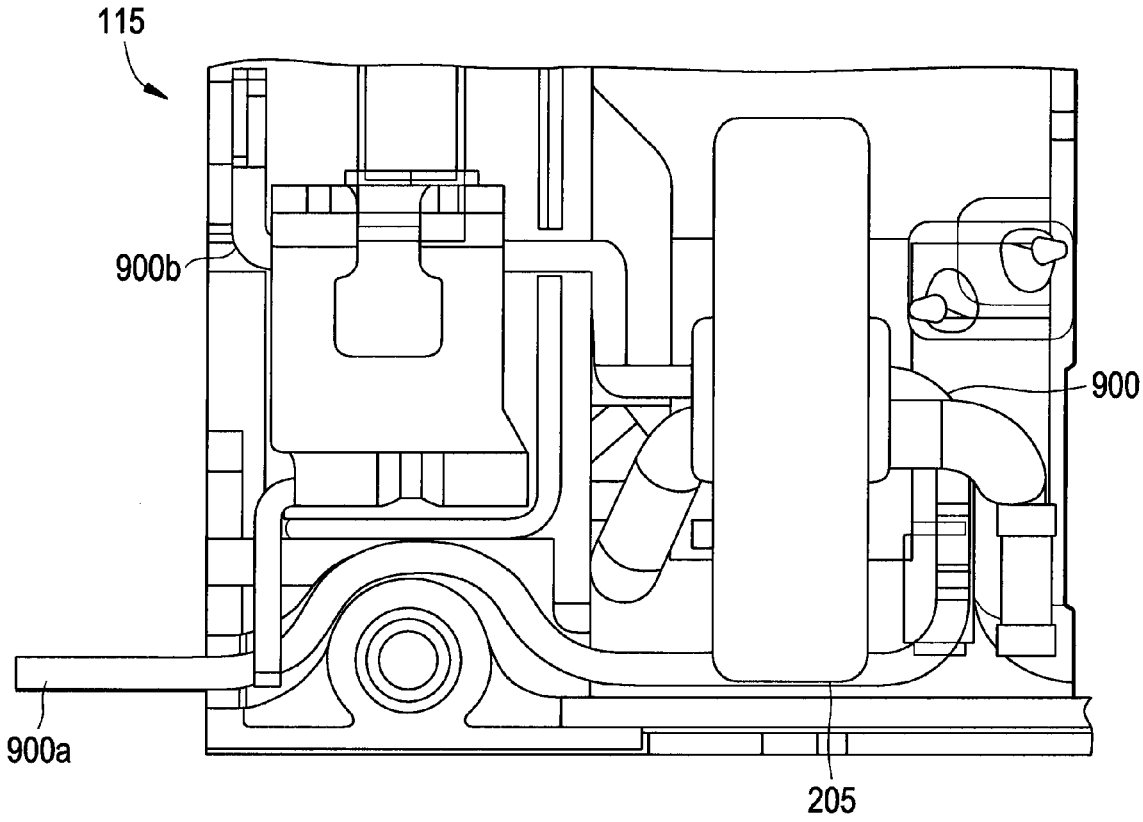
FIG. 20 is a detailed schematic diagram of the flying neutral conductor as shown on the RCD side of the circuit breaker in accordance with an embodiment of the present invention.

FIG. 20 is a diagram illustrating the flying neutral conductor 900 shown in FIG. 19 from the RCD side 200 of the circuit breaker 100 in accordance with an embodiment of the present invention. As shown in FIG. 20, on the RCD side 200 it can be seen that the second end portion **900*b* of the flying neutral conductor 900 is connected at the second circuit connection portion 115 of the circuit breaker 100. Further as shown, the flying neutral conductor 900 is disposed through the center of the current transformer 205 on the RCD side 200**.

Figure 21:
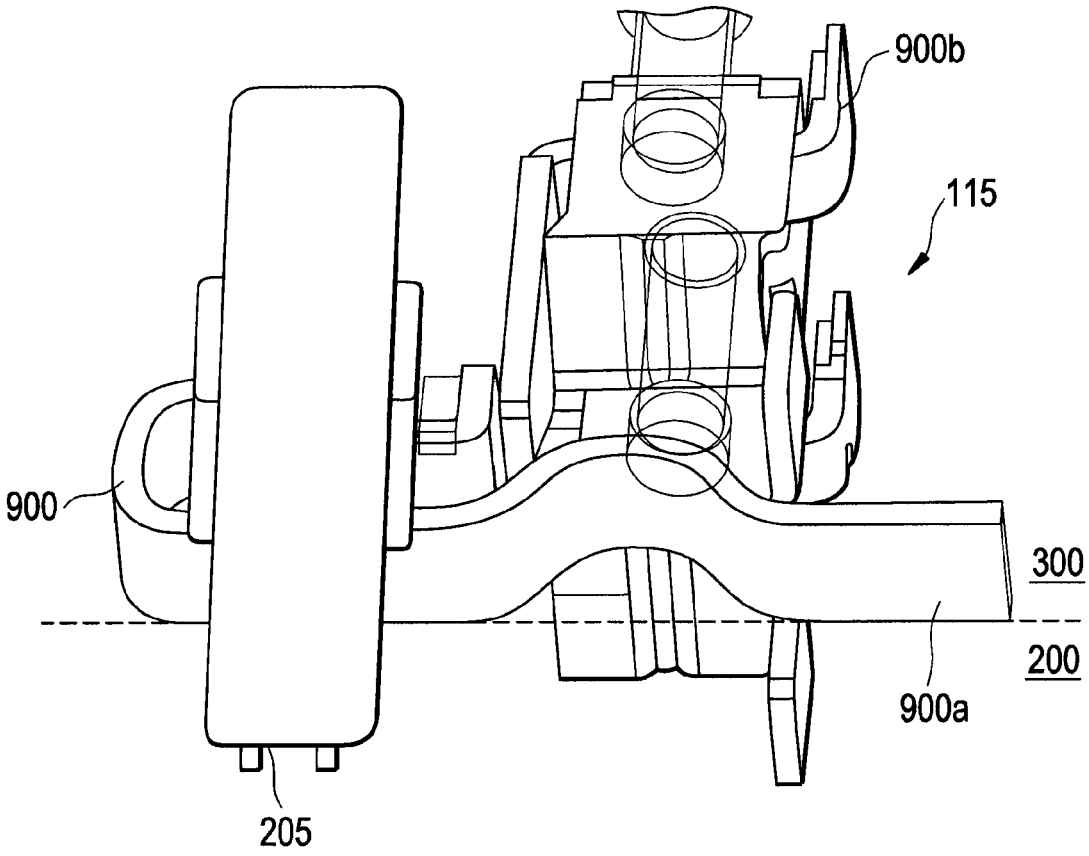
FIG. 21 is a perspective view of the flying neutral conductor from the RCD side and the MCB pole side of the circuit breaker in accordance with an embodiment of the present invention.

FIG. 21 is a perspective view of the flying neutral conductor 900 from both the RCD side 200 and the MCB pole side 300 of the circuit breaker 100 in accordance with an embodiment of the present invention. As shown in FIG. 21, the flying neutral conductor 900 is configured to be disposed on the MCB pole side 300 and to extend to the RCD side 200. That is, as shown in FIG. 22, the flying neutral conductor 900 extends from the MCB side 300 to the RCD side 200 within the circuit breaker 100.

Embodiments of the present invention provide a compact electronic Residual Current Circuit Breaker with Overcurrent Protection (eRCBO) where the PCB of the circuit breaker is installed in substantially half of the single pole module. Further, the PCB is arranged such that a trip solenoid thereof interfaces with a lever mechanism for tripping the MCB mechanism located on an adjacent portion of the circuit breaker. Further, according to an embodiment of the present invention, the circuit breaker connection arrangement includes a flying neutral conductor accommodated in substantially half of the 18 mm module.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A single pole module of a circuit breaker, comprising:

a first portion having a first current path region;

a second portion adjacent to the first portion having a second current path region, an interior wall separating the first portion from the second portion;

the first portion of the single pole module comprising a first section configured to receive a circuit board and a second section configured to receive a lever mechanism;

the second portion of the single pole module comprising a first section configured to receive an electromagnetic protection device, a second section configured to receive an arc extinguishing device, a third section configured to receive a thermal protection device, and a fourth section configured to receive an operating mechanism;

wherein the first and second sections of the first portion occupy substantially half of the single pole module and the first, second, third and fourth sections of the second portion occupy substantially half of the single pole module; and wherein the second section of the first side and the third and fourth sections of the second portion are disposed opposite each other.

2. The single pole module of claim 1, wherein the second section of the first portion and the third and fourth sections of the second portion are centrally disposed within the single pole module relative to a length of the single pole module.

3. The single pole module of claim 2, wherein the first section of the first portion and the first and second sections of the second portion occupy a substantial part of an internal width of the single pole module.

4. The single pole module of claim 3, wherein the first section of the first portion is disposed at an opposite end relative to the length of the single pole module from the first and second sections of the second portion.

5. The single pole module of claim 4, wherein the second section of the first portion and the third and fourth sections of the second portion are disposed in between the first section of the first portion and the first and second sections of the second portion.

6. The single pole module of claim 5, wherein the first portion of the single pole module forms an L-shape and the second portion of the single pole module forms an L-shape, wherein the first portion and the second portion comprise substantially a total area of the single pole module.

7. The single pole module of claim 6, further comprising an open portion adjacent to the first section of the second portion, configured to receive a phase conductor of the circuit breaker.

8. The single pole module of claim 6, further comprising a molded enclosure configured to receive a phase conductor of the circuit breaker.

9. A circuit breaker comprising:

a single pole module of a circuit breaker comprising a first portion including a first current path region and first and second sections and second portion opposite the first portion including a second current path region and first, second, third and fourth sections, the first and second portions being separated by an interior wall;

a circuit board comprising a trip solenoid disposed within the first section of the first portion;

a lever mechanism in operable communication with the trip solenoid and disposed within the second section of the first portion, the lever mechanism further comprising an end portion configured to be in operable communication with the trip solenoid and configured to be actuated by the trip solenoid upon a predetermined electrical condition;

a circuit protection device disposed in the first, second, third and fourth sections of the second portion and a tripping mechanism in operable communication with the circuit protection device and disposed within the third section of the second portion, wherein the lever mechanism is in operable communication with the tripping mechanism and configured to trip the circuit breaker.

10. The circuit breaker of claim 9, wherein the first and second sections of the first portion of the single pole module occupy substantially half of the single pole module and the first, second, third and fourth sections of the second portion of the single pole module occupy substantially half of the single pole module; and wherein the second section of the first portion and the third and fourth sections of the second portion are disposed opposite each other.

11. The circuit breaker of claim 10, wherein the lever mechanism includes a pin on a side thereof extending through the interior wall, and the third section of the second portion further comprises an activator in operable communication with the pin of the lever mechanism and configured to move when the lever mechanism is actuated.

12. The circuit breaker of claim 11, wherein the circuit breaker further comprises:

a fixed contact and a movable contact, and a movable contact arm having the movable contact disposed thereon, the contact arm being configured to separate the movable contact from the fixed contact when the activator moves; and a current transformer configured to monitor current flow.

13. The circuit breaker of claim 12, wherein the current transformer is disposed at an end of the circuit board opposite that of the trip solenoid; the current transformer being further disposed to straddle the circuit board.

14. The circuit breaker of claim 12, wherein the current transformer is disposed adjacent to the trip solenoid within the circuit board.

15. The circuit breaker of claim 12, further comprising:

an electromagnetic protection device in the first section of the second portion, an arc distinguishing device in the second section of the second portion, a thermal protection device in the third section of the second portion, and an operating mechanism in the fourth section of the second portion.

16. The circuit breaker of claim 15, further comprising:

circuit connection portions disposed at respective end portions of the single pole module and including a first circuit connection portion adjacent to the circuit protection device and second circuit connection portion adjacent to the circuit board.

17. The circuit breaker of claim 16, wherein
the first current path region comprising:
a neutral conductor at the second circuit connection portion, and
a side portion and a center portion of the current transformer, the first current path region configured to allow current to flow between the second circuit connection portion and the side portion and the center portion of the current transformer; and
the second current path region comprising:
a line conductor at the first circuit connection portion,
the electromagnetic protection device,
the thermal protection device,
the center portion of the current transformer, and
the second circuit connection portion, the second current path region configured to allow current to flow between the first circuit connection portion, the electromagnetic protection device, the thermal protection device, the center portion of the current transformer and the second circuit connection portion.

18. The circuit breaker of claim 16, wherein
the first current path region comprising:
a neutral conductor at the first circuit connection portion,
a side portion of the arc distinguishing device, and
a center portion of the current transformer, the first current path region configured to allow current to flow between the first circuit connection portion, the side portion of the arc distinguishing device and the center portion of the current transformer; and
the second current path region comprising:
the first circuit connection portion,
a line conductor at the second circuit connection portion,
the center portion of the current transformer, and
the thermal protection device, the second current path region configured to allow current to flow between the first circuit connection portion, the center portion of the current transformer, the thermal protection device and the second circuit connection portion.

19. The circuit breaker of claim 16, wherein
the first current path region comprising:
the first circuit connection portion,
a neutral conductor at the second circuit connection portion,
a center portion of the current transformer, and
a side portion of the arc distinguishing device, the first current path region configured to allow current to flow between the first circuit connection portion, the center portion of the current transformer, the side portion of the arc distinguishing device and the second circuit connection portion; and
the second current path region comprising:
a line conductor at the first circuit connection portion,
the electromagnetic protection device,
the movable contact arm,
the thermal protection device,
a center portion of the current transformer, and
the second circuit connection portion, the second current path region configured to allow current to flow between the first circuit connection portion, the electromagnetic protection device, the movable contact arm, the thermal protection device, the center portion of the current transformer and the second circuit connection portion.

20. The circuit breaker of claim 16, wherein
the first current path region comprising:
the first circuit connection portion,
a neutral conductor at the second circuit connection portion,
a center portion of the current transformer, and
a side portion of the arc distinguishing device, the first current path region configured to allow current to flow between the first circuit connection portion, the center portion of the current transformer, the side portion of the arc distinguishing device and the second circuit connection portion, and
the second current path region comprising:
the first circuit connection portion,
a line conductor at the second circuit connection portion,
a center portion of the current transformer,
the thermal protection device, and
the side portion of the arc distinguishing device, the second current path region configured to allow current to flow between the first circuit connection portion, the center portion of the current transformer, the thermal protection device, the side portion of the arc distinguishing device and the second circuit connection portion.

21. The circuit breaker of claim 17, wherein the first circuit connection portion comprises an open portion, and the circuit breaker further comprises a phase conductor housed within the open portion and having a U-shape, the phase conductor including a first end portion and a second end portion, the second end portion including a surface configured to electrically connect with the electromagnetic protection device.

22. The circuit breaker of claim 17, wherein the circuit breaker further comprises a flying neutral conductor disposed within the second circuit connection portion and comprising a first end portion extending from the second circuit connection portion and around a side of the current transformer and through a center of the current transformer, and the second end portion disposed at the second circuit connection portion.

* * * * *